US007999606B2

(12) United States Patent
Kung et al.

(10) Patent No.: US 7,999,606 B2
(45) Date of Patent: Aug. 16, 2011

(54) TEMPERATURE INDEPENDENT REFERENCE CIRCUIT

(75) Inventors: David Kung, Hillsborough, CA (US); Leif Lund, San Jose, CA (US)

(73) Assignee: Power Intergrations, Inc., San Jose, CA (US)

( * ) Notice: Subject to any disclaimer, the term of this patent is extended or adjusted under 35 U.S.C. 154(b) by 0 days.

(21) Appl. No.: 12/931,377

(22) Filed: Jan. 31, 2011

(65) Prior Publication Data

US 2011/0121889 A1 May 26, 2011

Related U.S. Application Data

(63) Continuation of application No. 12/587,204, filed on Oct. 2, 2009, now Pat. No. 7,893,754.

(51) Int. Cl.
*G05F 1/10* (2006.01)

(52) U.S. Cl. ..... 327/538; 327/513

(58) Field of Classification Search ..... 323/315; 327/512, 513, 538, 539, 543
See application file for complete search history.

(56) References Cited

U.S. PATENT DOCUMENTS

| | | | | |
|---|---|---|---|---|
| 6,724,244 | B2 * | 4/2004 | Wu | 327/543 |
| 6,933,769 | B2 * | 8/2005 | Koelling | 327/538 |
| 7,193,402 | B2 * | 3/2007 | Lee et al. | 323/313 |
| 7,301,389 | B2 * | 11/2007 | Coady | 327/539 |
| 7,348,830 | B2 * | 3/2008 | Debroux | 327/538 |
| 7,616,050 | B2 * | 11/2009 | Eckstein | 327/538 |

* cited by examiner

*Primary Examiner* — Jeffrey S Zweizig
(74) *Attorney, Agent, or Firm* — The Law Offices of Bradley J. Bereznak

(57) ABSTRACT

A temperature independent reference circuit includes first and second bipolar transistors with commonly coupled bases. First and second resistors are coupled in series between the emitter of the second bipolar transistor and ground. The first and second resistors have first and second resistance values, R1 and R2, and third and second temperature coefficients, TC3 and TC2, respectively. The resistance values being such that a temperature coefficient of a difference between the base-emitter voltages of the first and second bipolar transistors, TC1, is substantially equal to TC2×(R2/(R1+R2))+TC3×(R1/(R1+R2)), resulting in a reference current flowing through each of the first and second bipolar transistors that is substantially constant over temperature. A third resistor coupled between a node and the collector of the second bipolar transistor has a value such that a reference voltage generated at the node is substantially constant over temperature.

13 Claims, 2 Drawing Sheets

TEMPERATURE INDEPENDENT REFERENCE CIRCUIT

This application is a continuation of application Ser. No. 12/587,204, filed Oct. 2, 2009, entitled, "Temperature Independent Reference Circuit", which is assigned to the assignee of the present application.

TECHNICAL FIELD

The present disclosure generally relates to the field of temperature independent reference circuits, more particularly, to temperature independent voltage reference and temperature independent current reference circuits manufactured on a semiconductor chip.

BACKGROUND

Temperature independent reference circuits have been widely used in integrated circuits (ICs) for many years. The purpose of a temperature independent reference circuit is to produce a reference voltage and/or a reference current that are substantially constant with temperature. In prior art ICs, a temperature-compensated reference voltage and a temperature-compensated reference current are sometimes generated on the same silicon chip using separate circuits. Typically, a temperature independent voltage reference is first derived and then a temperature independent current is derived using the temperature independent voltage. A drawback of this approach, however, is that the circuitry utilized to separately generate the reference voltage and reference current is usually complex and typically occupies a large area of the semiconductor (e.g., silicon) die.

BRIEF DESCRIPTION OF THE DRAWINGS

The present invention is illustrated by way of example, and not limitation, in the figures of the accompanying drawings, wherein.

DESCRIPTION OF EXAMPLE EMBODIMENTS

In the following description specific details are set forth, such as device types, conductivity types, voltages, component values, configurations, etc., in order to provide a thorough understanding of the present invention. However, persons having ordinary skill in the relevant arts will appreciate that these specific details may not be needed to practice the embodiments described.

It should be appreciated that although an IC utilizing specific transistor types in certain circuit configurations is disclosed (e.g., N-channel field-effect transistors), different transistor types (e.g., P-channel) may also be utilized in alternative embodiments. In still other embodiments, some or all of the metal-oxide-semiconductor field-effect transistor (MOSFET) devices show by way of example may be replaced with bipolar junction transistors (BJTs), insulated gate field effect transistor (IGFETs), or other device structures that provide a transistor function. Furthermore, those of skill in the art of integrated circuits and voltage and/or current reference circuits will understand that transistor devices such as those shown by way of example in the figures may be integrated with other transistor device structures, or otherwise fabricated or configured in a manner such that different devices share common connections and semiconductor regions (e.g., N-well, substrate, etc.). For purposes of this disclosure, "ground" or "ground potential" refers to a reference voltage or potential against which all other voltages or potentials of a circuit or IC are defined or measured.

Figure 1:
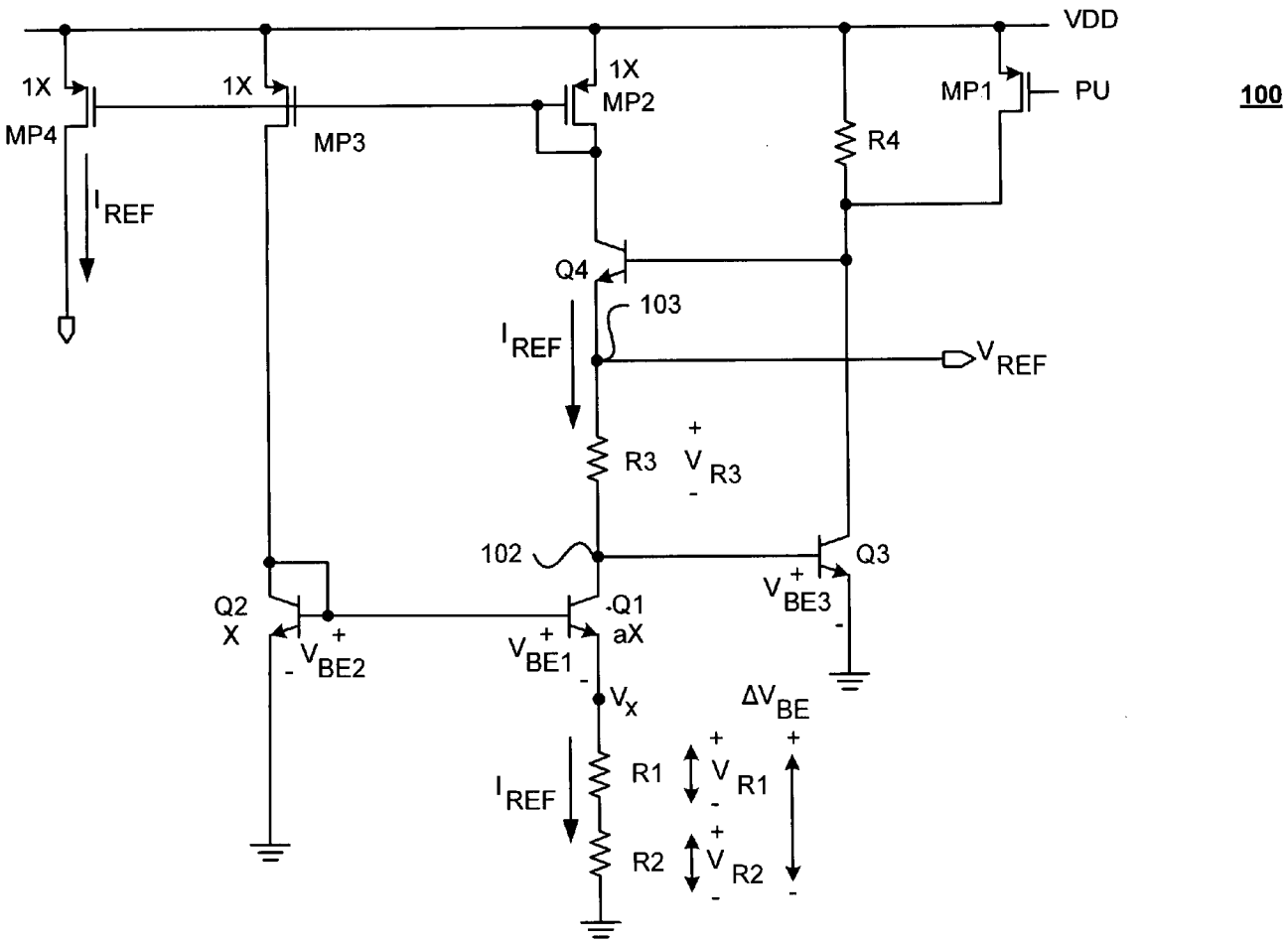
FIG. 1 illustrates a circuit schematic diagram of a temperature independent reference circuit for simultaneously generating both a temperature-compensated reference voltage and a temperature-compensated reference current on an integrated circuit (IC).

FIG. 1 illustrates a circuit schematic diagram of a temperature independent reference circuit 100 for generating both a temperature-compensated reference voltage and a temperature-compensated reference current at the same time on an IC. (In the context of the present application, the term "IC" is considered synonymous with a monolithic device.) Temperature independent reference circuit 100 includes NPN bipolar transistors Q1, Q2, Q3 and Q4. Transistors Q1 & Q2 are matched devices with Q1 having an emitter size ratio of "a" with respect to emitter size of Q2, where "a" is an integer greater than 1. The emitter of Q2 is shown coupled to ground. The emitter of Q1, node $V_X$, is coupled to ground through series-connected resistors R1 and R2. In the embodiment shown, a temperature independent current reference $I_{REF}$ flows through resistors R1 and R2, where $I_{REF}=V_X/(R1+R2)$. The collector of Q1, node 102, is coupled to the base of Q3 and an end of resistor R3. The other end of R3, node 103, is connected to the emitter of transistor Q4. Node 103 provides a temperature independent voltage reference $V_{REF}$ that is derived from the temperature independent current reference $I_{REF}$, as described in more detail below.

Continuing with the example of FIG. 1, the base of transistor Q4 is commonly coupled to the collector of Q3, resistor R4, and the drain of p-channel metal-oxide-semiconductor field-effect transistor (PMOS) MP1. The other end of R4 and the source of MP1 are connected to the voltage supply potential VDD. The gate of MP1 is coupled to receive a power-up (PU) signal that ensures the proper operation of the circuit. At power-up, VDD ramps up from ground potential and PU is initially low to drive current into the base of Q4. When VDD reaches a potential high enough for circuit 100 to operate, power-up signal PU transitions to high, thereby turning off MP1.

Temperature independent reference circuit 100 further includes PMOS transistor MP2 coupled between VDD and the collector of Q4. The gate and drain of MP2 are commonly coupled to the gates of matched PMOS transistors MP3 and MP4 in a current mirror configuration with NPN transistors Q1 & Q2 so as to reflect the temperature independent current reference $I_{REF}$ through MP4 for output elsewhere on the IC. Practitioners in the art will appreciate that the circuit of FIG. 1 generates a temperature compensated current $I_{REF}$, which current is then utilized to generate a temperature compensated voltage $V_{REF}$ at node 103. To achieve this result, resistors R3 and R1 have a ratio of M and are matched, meaning that they have the same temperature coefficient of resistance due to the fact that they are fabricated of the same material on the IC. In one embodiment, R1 and R3 comprise a semiconductor material implanted or diffused with P type dopant.

A temperature coefficient TC may be defined as the relative change of a physical property when the temperature is changed by one degree C. The temperature coefficient of resistors R3 and R1, TC3, is positive and larger than the positive temperature coefficient of $\Delta V_{BE}$, TC1. In particular, $\Delta V_{BE}$ is the difference between the voltage across base to emitter of transistors Q1 and voltage across base to emitter of transistor Q2. Resistor R2 is fabricated of a different material type (e.g., polysilicon) as compared to resistors R3 and R1. The temperature coefficient, TC2, of R2 is also positive but smaller than TC1. When this circuit is operating properly, the currents flowing thru Q1 and Q2 are forced to be equal by the current mirror transistors MP2 and MP3, resulting in a $\Delta V_{BE}$ across the series connected resistors R1 and R2. The resistance ratio of R1/R2 is chosen such that, TC1=TC2×(R2/(R1+R2))+TC3×(R1/(R1+R2)). This makes the change over temperature in the combined resistance, R1+R2, the same as the change over temperature in $\Delta V_{BE}$, resulting in a current $I_{REF}$ flowing thru R1 and R2 that is constant over temperature.

To better understand the operation of temperature independent reference circuit 100, temperature independent current reference $I_{REF}$ may be expressed mathematically by the equation:

$$I_{REF} = \frac{\Delta V_{BE}}{(R_1 + R_2)} \tag{1}$$

To achieve temperature independent current reference $I_{REF}$, the percent change in $\Delta V_{BE}$ should be equal to the percent change in total resistance (R1+R2). As further shown, the percent change in $\Delta V_{BE}$ may be calculated by the equation (2) below:

Percent change in $$\Delta V_{BE} = \left(\frac{\Delta V_{BEF} - \Delta V_{BEI}}{\Delta V_{BEI}}\right) \cdot 100\% \tag{2}$$

where $\Delta V_{BEF}$ represents the difference in base-to-emitter voltage between Q1 & Q2 at a final temperature and $\Delta V_{BE}$, represents the difference in base-to-emitter voltage between Q1 & Q2 voltage at an initial temperature.

It is known to one skilled in the art that $\Delta V_{BE}$ may be determined based on the following equation:

$$\Delta V_{BE} = V_{BE2} - V_{BE1} = V_T \cdot \ln a \tag{3}$$

where ln is the natural logarithm, "a" is the relative sizing ratio of Q1 with respect to Q2, and $V_T$ is a constant that varies only as temperature varies. This leads into equation (4), shown below, which gives the percent change of $\Delta V_{BE}$ in terms of $V_T$:

Percent change in $$\Delta V_{BE} = \left(\frac{V_{TF} \cdot \ln a - V_{TI} \cdot \ln a}{V_{TI} \cdot \ln a}\right) \cdot 100\% \tag{4}$$

where $V_{TF}$ is the value of the constant $V_T$ at a final temperature and $V_{TI}$ is the value of the constant $V_T$ at an initial temperature.

As shown, the percent change in (R1+R2) may be calculated by the equation (5) below:

Percent change in $$(R_1 + R_2) = \left(\frac{R_{1F} - R_{1I}}{R_{1I} + R_{2I}}\right) \cdot 100\% + \left(\frac{R_{2F} - R_{2I}}{R_{1I} + R_{2I}}\right) \cdot 100\% \tag{5}$$

The above equation can be realized by setting R1 and R2 depending on the percent change of the resistance of each resistor such that the total percent change over temperature of the total resistance matches the total percent change over temperature of $\Delta V_{BE}$. As explained above, in one embodiment, resistors R1 and R2 are manufactured of different materials, so the percentage change in resistance value over temperature is different between the two resistors.

By way of example, if we assume that $\Delta V_{BE}$ varies by 33% over 100° C. (e.g., $\Delta V_{BEF}$=48 mV, $\Delta V_{BE1}$=36 mV), and R1 and R2 vary respectively by 60% and 6% over the same temperature range, then the ratio of R1 to R2 may be 50/50, meaning that R1 provides 30% and R2 provides 3% of the temperature compensation that substantially cancels out the 33% change of $\Delta V_{BE}$. In other words, the change in percentage over temperature in the combined resistance, R1+R2, is set to be the same as the change in percentage over temperature in $\Delta V_{BE}$, resulting in a current $I_{REF}$ flowing thru R1 and R2 that is substantially constant over temperature.

Turning now to the temperature independent voltage reference aspect of temperature independent reference circuit 100, the output reference voltage $V_{REF}$ generated at node 103 is related to the voltage across resistor R3, $V_{R3}$, which is established by $I_{REF}$ (e.g., $V_{R3}$=R3×$I_{REF}$). Since $I_{REF}$ does not substantially vary with temperature as discussed above, the voltage $V_{R3}$ possesses the same temperature coefficient as R3 (i.e., TC3). As shown, the output reference voltage $V_{REF}$ is the sum of the $V_{BE}$ of Q3 ($V_{BE3}$), which typically has a temperature coefficient −2 mV/° C., plus the voltage $V_{R3}$ which has a positive temperature coefficient of TC4. Stated in different mathematical terms, $$V_{REF} = V_{BE3} + V_{R3} \tag{6}$$

Equation (6) shows that to achieve a temperature independent voltage, $V_{REF}$, the change in voltage drop $V_{R3}$ over temperature must substantially equal to the absolute value of the change in $V_{BE3}$ over temperature. That is, the temperature variation of $V_{R3}$ is set to be approximately +2 mV/° C. to substantially cancel out the temperature variation of the $V_{BE3}$.

Another way to look at it is that change in resistance R3 is made to cancel out the change in voltage $V_{BE3}$ over a given temperature range, as represented in equation (7) below, where $V_{BE3F}$ and $V_{BE3I}$ are the final and initial base-emitter voltages, and $V_{R3F}$ and $V_{R3I}$ are the final and initial voltages across R3, at high and low temperatures, respectively.

$$V_{BE3F} - V_{BE3I} = -(V_{R3F} - V_{R3I}) \tag{7}$$

For example, let us assume that the temperature coefficient of $V_{BE3}$ is exactly −2 mV/° C., so that over a 100° C. increase in temperature the voltage drop across $V_{BE3}$ decreases by 200 mV. To achieve a temperature independent output reference voltage $V_{REF}$, the voltage drop $V_{R3}$ must also increase by 200 mV over the same 100° C. increase in temperature. Since R3 and R1 are matched resistors (i.e., made of the same material) their resistance values both change in the same percentage over a unit temperature. The reference output current $I_{REF}$ is set in accordance with the description provided above, which means that R3 may be determined by the following equation.

$$R_3 = \frac{\Delta V_{R3}}{\Delta V_{R1}} \cdot R_1 \tag{8}$$

where $\Delta V_{R3}$=$V_{R3F}$ $V_{R3I}$ and $\Delta V_{R1}$=$V_{R1F}$ $V_{R1I}$. The change in $V_{R1}$ is set due to the resistance value of R1 and $I_{REF}$. In the example, the change in $V_{R3}$ is 200 mV. Therefore, R3 may be determined such that the decrease of voltage $V_{BE3}$ is the same as the increase of voltage drop $V_{R3}$ over a change in unit temperature.

Figure 2:
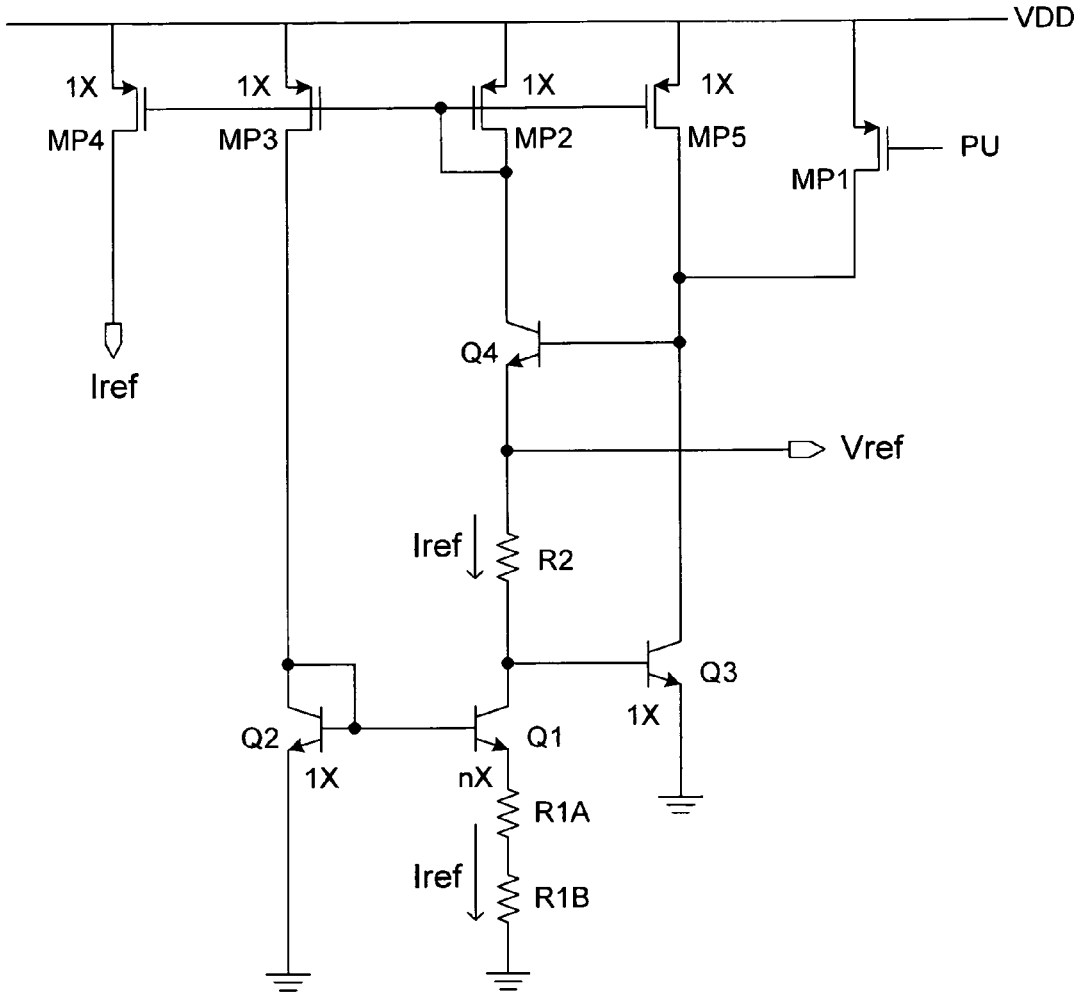
FIG. 2 illustrates another example circuit schematic diagram of a temperature independent reference circuit for simultaneously generating both a temperature-compensated reference voltage and a temperature-compensated reference current on an integrated circuit (IC).

FIG. 2 illustrates another example circuit schematic diagram of a temperature independent reference circuit 200 for simultaneously generating both a temperature-compensated reference voltage and a temperature-compensated reference current on an integrated circuit (IC). Temperature independent reference circuit 200 is identical to circuit 100 of FIG. 1 in every respect, except that resistor R4 in temperature independent reference circuit 100 is replaced by PMOS transistor MP5 in temperature independent reference circuit 200. PMOS transistor MP5 functions as another current mirror transistor, which ensures the current flowing thru NPN transistor Q3 remains constant over temperature. In addition, another advantage for replacing resistor R4 with transistor MP5 is to reduce total area of temperature independent reference circuit 200. Practitioners in the art will understand that this improvement eliminates a relatively minor error term in $V_{REF}$ present in the embodiment of FIG. 1. This error term tends to cause a slight change in $V_{REF}$ due to current density changes in the voltage $V_{BE3}$.

Although the present invention has been described in conjunction with specific embodiments, those of ordinary skill in the arts will appreciate that numerous modifications and alterations are well within the scope of the present invention. Accordingly, the specification and drawings are to be regarded in an illustrative rather than a restrictive sense.

We claim:

1. An integrated circuit (IC) fabricated on a semiconductor substrate comprising:

first and second bipolar transistors, the base and collector of the first bipolar transistor being coupled to the base of the second bipolar transistor, a size ratio of the emitter of the second bipolar transistor to the emitter of the first bipolar transistor being equal to N, where N is an integer greater than 1, the emitter of the first bipolar transistor being coupled to a ground potential;

first and second resistors coupled in series between the emitter of the second bipolar transistor and the ground potential, the first and second resistors having first and second resistance values, R1 and R2, and third and second temperature coefficients, TC3 and TC2, respectively;

a current mirror coupled to the first and second bipolar transistors such that a first current flows through each of the first and second bipolar transistors when power is supplied to the IC, the first and second resistance values being such that a temperature coefficient of a difference between the base-emitter voltages of the first and second bipolar transistors, TC1, is substantially equal to $$TC2\times(R2/(R1+R2))+TC3\times(R1/(R1+R2))$$

resulting in the first current being substantially constant over temperature.

2. The IC of claim 1 further comprising:

a third bipolar transistor, the emitter of the third bipolar transistor being coupled to the ground potential, the base of the third bipolar transistor being coupled to the collector of the second bipolar transistor; and a third resistor coupled between a node and the collector of the second bipolar transistor, the first current flowing through the third resistor when power is supplied to the IC, the third resistor having a third resistance value, R3, and the third temperature coefficient TC3.

3. The IC of claim 2 wherein the third resistance value is such that a percent change of the base-emitter voltage of the third bipolar transistor is substantially equal to the percent change of a voltage drop across the third resistor over temperature, thereby resulting in a first voltage being generated at the node that is substantially constant over temperature.

4. The IC of claim 1 wherein the first and third resistors comprise a first material type and the second resistor comprises a second material type.

5. The IC of claim 4 wherein the first material type comprises a p type implant.

6. The IC of claim 5 wherein the second material type comprises polysilicon.

7. The IC of claim 2 further comprising a fourth bipolar transistor, the base of the fourth bipolar transistor being coupled to the collector of the third bipolar transistor, the emitter of the fourth bipolar transistor being coupled to the node, and the collector of the fourth bipolar transistor being coupled to the current mirror.

8. The IC of claim 7 wherein the current mirror comprises first and second transistors, the collector of the fourth bipolar transistor being coupled to the second transistor.

9. The IC of claim 8 wherein the first and second transistors comprise first and second p-channel field-effect transistors, respectively.

10. The IC of claim 9 further comprising a third p-channel field-effect transistor coupled to the first and second p-channel field-effect transistors, the third p-channel field-effect transistor being configured to output the first current.

11. The IC of claim 10 further comprising a fourth resistor coupled between a supply line and the collector of the third bipolar transistor.

12. The IC of claim 11 further comprising a fourth p-channel field-effect transistor coupled between the supply line and the collector of the third bipolar transistor.

13. The IC of claim 11 wherein the gate of the fourth p-channel field-effect transistor is coupled to receive a power-up (PU) signal that is initially low at power-up of the IC, the PU signal transitioning high after the supply line reaches a voltage potential sufficiently high enough to operate the IC.

* * * * *